US006028046A

United States Patent [19]

Arif

[11] Patent Number: 6,028,046

[45] Date of Patent: Feb. 22, 2000

[54] DETERGENTS WITH POLYAMINE ALKOXYLATES USEFUL IN CLEANING DYED FABRICS WHILE INHIBITING DYE TRANSFER

[75] Inventor: Shoaib Arif, Dublin, Ohio

[73] Assignee: Witco Corporation, Greenwich, Conn.

[21] Appl. No.: 08/909,248

[22] Filed: Aug. 11, 1997

[51] Int. Cl.[7] ..... C11D 1/40; C11D 1/62

[52] U.S. Cl. ..... 510/356; 510/341; 510/350; 510/433; 510/360; 510/499; 510/423; 510/503; 510/504

[58] Field of Search ..... 510/341, 350, 510/299, 433, 356, 360, 421, 423, 475, 499, 503, 504

[56] References Cited

U.S. PATENT DOCUMENTS

| | | | |
|---|---|---|---|
| 3,627,473 | 12/1971 | Bauman . | |
| 4,101,690 | 7/1978 | Miyamoto et al. | 427/150 |
| 4,134,971 | 1/1979 | Inoue et al. | 424/128 |
| 5,451,341 | 9/1995 | White | 252/547 |
| 5,466,802 | 11/1995 | Panandiker et al. | 544/193.2 |

FOREIGN PATENT DOCUMENTS

| | | |
|---|---|---|
| 4031844 | 4/1992 | Germany . |
| WO 95/06703 | 3/1995 | WIPO . |
| WO 95/23840 | 9/1995 | WIPO . |

*Primary Examiner*—Yogendra Gupta
*Assistant Examiner*—Dawn L. Garrett
*Attorney, Agent, or Firm*—Scully, Scott, Murphy & Presser

[57] ABSTRACT

Washing dyed fabrics in compositions which comprise a polyamine alkoxylate component of formula (A)

(A)

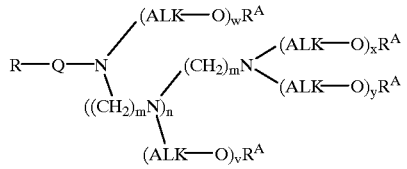

and mixtures thereof, wherein R is an alkyl or alkenyl radical containing 6 to 25 carbon atoms and 0 to 3 carbon-carbon double bonds, and each ALK is ethyl or propyl, v, w, x and y are each 1–20, n is 0–10, (v+w+x+y) is (3+n) to 20, affords cleaning while inhibiting dye loss and dye transfer from the fabric.

20 Claims, No Drawings

DETERGENTS WITH POLYAMINE ALKOXYLATES USEFUL IN CLEANING DYED FABRICS WHILE INHIBITING DYE TRANSFER

BACKGROUND OF THE INVENTION

The present invention relates to compositions useful in cleaning fabric as well as other soft surfaces such as carpeting. In particular, the present invention relates to cleaning dyed fabrics for removing soil and stains while retaining brightness and resisting dye loss and dye transfer from the fabrics.

The large variety of products currently available commercially for use in cleaning fabrics contain various nonionic, anionic and amphoteric surfactants. The conventional nonionic surfactants are primary and secondary alcohol ethoxylates and alkyl phenol ethoxylates. These, however, suffer from several drawbacks. In particular, they are associated with excessive dye transfer and dye loss when they are used to wash dyed fabrics. The conventional anionic surfactants such as alkyl benzene sulfonates, alkyl sulfates, alkyl ether sulfates, α-olefin sulfonates etc. are likewise associated with excessive dye transfer and dye loss in such uses.

The conventional nonionic surfactants, as well as anionic surfactants, and mixtures thereof, are conventionally formulated into so-called "built" liquid detergents, or solid particulate products, which require the presence of numerous additional additives to contribute necessary properties and to adjust the performance of the overall compositions. For instance, since liquid products need to be formulated with water, they generally require one or more hydrotropes, suspending agents, stabilizing agents, and/or emulsifying agents. On the other hand, so-called "unbuilt" liquid detergent compositions chemically contain higher surfactant levels to compensate for the absence of builder components. In either case, considerable amounts of material are required to provide phase stability as formulated in water, and to provide cleaning performance which has come to be considered acceptable.

More particularly, the builder components are provided to help deal with water hardness, and to adjust the overall fluidity of the composition. Hydrotropes are required, to help maintain solubility and the desired monophasic state of the composition at the relatively lower temperatures which the composition might encounter upon storage or shipment. Polymeric additives such as polyvinyl pyrrolidone are often necessary, to help impart dye transfer inhibition to the product. Also, it is known to incorporate antiredeposition agents, to prevent soil from being redeposited on the fabric during the washing. Some commercial products suffer from excessive viscosity and gel formation even upon storage in a cold basement. Such a property obviously would contribute to the unpopularity of the product with a consumer.

The conventionally accepted necessity for employing high solids contents, and relatively large amounts of so many additives, contributes to shipping and storage costs, and consumes excessive quantities of packaging. These additives are then wasted when the wash water is discarded; this also poses a burden on wastewater treatment systems.

Thus, it would be desirable to be able to obtain equivalent or superior cleaning performance, coupled with improved dye transfer inhibition, while being able to retain superior physical properties, all in formulations requiring a smaller amount of solids. In that way, greater efficiency can be attained with a lesser amount of product, thereby contributing also to reduction in demand for packaging material, storage space, and transport expense.

The cleaning products disclosed herein containing fatty polyamine alkoxylates, particularly ethoxylates, provide these advantages and many more described herein. The polyamine alkoxylates can be considered multifunctional, in that they contribute several properties to the cleaning formulations which thereby eliminate the need for additives which would otherwise be required. In addition, these alkoxylates are liquid and retain their liquidity even when compounded with other ingredients. Thus, the formulator is not required to add water, so the formulator thereby avoids the need to provide additional components to help stabilize the solids contained in the water. Indeed, the polyamine alkoxylates retain their fluidity even at high total solids content. Conventionally, formulators are unable to make products approaching 80–100 wt. % solids, whereas formulators using diamine and triamine alkoxylates can attain very high solids content. This, in turn, permits formulation of concentrates, which remain liquid even as concentrates, which one may dilute with water if desired to obtain products which are very effective even with lesser solids contents.

It is generally recognized, however, that the ability of a given product to remove soil in general from soiled fabric does not necessarily correlate with an ability to remove a stain or spot from the fabric. Also, soil removal and stain removal do not imply satisfactory retention of whiteness and brightness. It is thus highly desirable to identify cleaning compositions, useful as detergents, which are particularly effective in all desired properties, including cleaning stains and spots from fabric, while retaining whiteness and color brightness, without undergoing loss of dye from dyed fabrics.

SUMMARY OF THE INVENTION

The present invention satisfies these needs and exhibits as well the additional features and comparative advantages described herein.

One aspect of the present invention is polyamine alkoxylates useful in cleaning dyed fabric while inhibiting loss of dye from the fabric, comprising (A) compounds of formula (A):

(A)

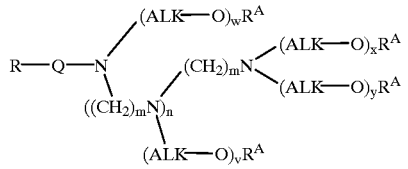

wherein

R is an alkyl or alkenyl radical containing 6 to 25 carbon atoms and 0 to 3 carbon-carbon double bonds;

Q is —OCH$_2$CH$_2$CH$_2$—, —C(=O)OCH$_2$CH$_2$—, —C(=O)NHCH$_2$CH$_2$CH$_2$—, or —CH$_2$—;

each occurrence of R$^A$ is independently H, —OC(=O)R, —SO$_3^-$A$^+$, or —CH$_2$C(=O)O$^-$A$^+$ wherein A$^+$ is an alkali metal cation, ammonium, or H$^+$;

each occurance of m is 3 to 8;

each ALK is independently ethyl, isopropyl or n-propyl;

v, w, x and y are each independently 1 to 20, n is 0 to 10, and the sum of (v+w+x+y) is (3+n) to 20;

(B) compounds composed of (i) a cation wherein one or more nitrogen atoms of a compound of formula (A) is additionally substituted with hydrogen, methyl, ethyl, hydroxyethyl or benzyl, and (ii) one or more anions, equal in number to the number of said additionally substituted nitrogen atoms, being selected from the group consisting of chloride, methylsulfate, and ethylsulfate; and compounds corresponding to amine oxides of compounds of formula (A).

Another aspect of the invention is a method of washing a dyed fabric while inhibiting loss of dye from the fabric, such as washing the fabric with an anionic surfactant having a tendency to remove dye from said fabric, comprising washing the dyed fabric with an aqueous cleaning composition which comprises one or more of said polyamine alkoxylates and which may also contain an anionic surfactant.

As will be described herein, the composition can also comprise a second surfactant, or a mixture of several surfactants, of any of these types: anionic surfactants, nonionic surfactants which do not conform to formula (A), and amphoteric surfactants.

The present invention has been found to be particularly applicable to a variety of types of stains, including ink, pigments, fruit juices, wine, coffee, tea, grass and similar plant material, as well as conventional dirt and soil, including makeup, and also proteinaceous stain material such as blood.

The compounds of formulas (A) and (B) show, surprisingly, significantly improved dye transfer inhibition, compared to monoamine alkoxylates, seen as equivalent levels of dye transfer inhibition at much lower (nearly 10-fold) concentrations than that of the corresponding monoamine alkoxylate.

DETAILED DESCRIPTION OF THE INVENTION

Formulations

The polyamine alkoxylate and component of the compositions of the present invention can comprise a single compound corresponding to formulas (A) and/or (B), but more often will comprise a mixture of compounds corresponding to such formulas. In formulas (A) and (B), the substituents R can be any alkyl or alkenyl radical containing 6 to 25 carbon atoms and 0 to 3 carbon-carbon double bonds. However, highly satisfactory commercial products comprise mixtures of compounds of formula (A), mixtures of compounds of formula (B), or mixtures of compounds of formulas (A) and (B). These are usually mixtures of compounds wherein the R radicals and/or the alkoxylate chains can vary in length and the R chains can vary in degree of saturation and unsaturation.

Mixtures of compounds of formulas (A) and (B) will often be found when synthesized with a quaternizing agent or acid used in an amount less (on a molar basis) than the amount of polyamine alkoxylate present.

The alkoxy groups ALK-O can each be ethoxy or propoxy. The alkoxylate chains can also contain random mixtures of individual ethoxy and propoxy units, or can be composed of blocks of ethoxy and of propoxy, or can be entirely ethoxy or entirely propoxy. Preferred compounds are the ethoxylates, i.e. where each ALK-O group is ethoxy.

For instance, highly preferred diamine and triamine alkoxylates can be obtained by alkoxylation of the commercial products known as "Adogen 560", and "Adogen 670", sold by Witco Corporation, each of which is respectively a mixture of compounds of formulas (A) and (B) wherein the R radical is present in several different lengths. In the case of the diamine "Adogen 560", the R radical is derived from coconut fatty acids, and in the case of the triamine "Adogen 670" the R radical is derived from tallow which as is known contains predominantly alkyl and alkenyl chains which contain 14, 16, and 18 carbon atoms.

The amine alkoxylates useful in this invention can have identical alkoxylate chains, but useful products include mixtures wherein the lengths of the alkoxylate chains can vary as shown by the subscripts v, w, x and y. Referring again to formula (A), the preferred amine alkoxylate compounds contain a total of 3 to 20 alkoxy units per molecule.

Compounds of formula (A) can be synthesized in a straightforward manner by alkoxylation of the corresponding amines $R—NH(CH_2)_mNH_2$ and $RNH((CH_2)_mNH)_n(CH_2)_mNH_2$. For instance, a primary amine $R—NH_2$ can be reacted with acrylonitrile (e.g. at 50 to 60° C. over 1–2 hours) to form an aminonitrile which is then reduced to a diamine, for instance by holding with a 1% Raney nickel catalyst in 300 psig partial pressure of hydrogen and 300 psig partial pressure of ammonia at 175° C. for 2–4 hours. The resulting diamine can be alkoxylated to form compounds of formula (A). It can also be reacted in the same process again with acrylonitrile followed by reduction, to form the triamine which can then be alkoxylated to compounds of formula (A) wherein n is 1. The process can be iterated as desired to form compounds of formula (A) wherein n is 2, 3, 4 or up to 10.

Compounds of formula (B) can be prepared by reacting a polyamine alkoxylate of formula (A) with a protic acid or with a quaternizing agent such as dimethylsulfate, benzyl chloride, or diethylsulfate.

In one broad aspect, the present invention comprises simply applying polyamine alkoxylate, (A), ionic polyamine alkoxylate (B), or a mixture thereof directly to the stain or soil which one desires to remove. The polyamine alkoxylate is allowed to remain on the stain or soil, for an effective time typically on the order of 0.1 to 60 minutes, and is then removed, either by rinsing or by immersing it into water in the washing cycle of a conventional automatic clothes washing machine.

One aspect of the present invention is compositions which are useful as, for instance, cleaners, detergents, and solids dispersants wherein the polyamine alkoxylate component of formula (A), formula (B), or both, is the sole component imparting the stain removal, soil removal, detergency, or dispersibility, as the case may be.

It has now also been discovered that superior products comprise compositions wherein a polyamine alkoxylate component of formula (A), (B) or both is present together with one or more anionic surfactants and/or one or more amphoteric surfactants and/or one or more second nonionic surfactants. By "second" nonionic surfactant is meant a nonionic surfactant which does not conform to formula (A). These compositions will also typically contain water.

The compositions can be highly concentrated, having a total surfactant content of at least 80 wt. % or even 90 wt. % or higher. These concentrates disperse readily into water on dilution. Providing product as a concentrate provides considerable savings to formulators, shippers, vendors and users in that they impose lower requirements of volume, weight and costs of shipping and storage. Those compositions which are concentrates, which are useful per se or are useful upon further dilution with water, are considered within the scope of this invention.

The present invention also encompasses compositions of lower concentration, e.g. on the order of 0.1 wt. % to 20 wt. % which range embraces the total surfactant content as customarily used by the end-user. Such compositions of intermediate concentrations from 20 to 80 wt. %, are also within this invention.

Among the suitable anionic surfactants useful in the present invention together with the polyamine alkoxylate component are anionic surfactants, which are preferably present as ammonium salts, amine salts or as salts of an alkali metal such as sodium or potassium. Preferred ammonium salts are formed with $N^+(A^1)(A^2)(A^3)(A^4)$ wherein each of $A^1$, $A^2$, $A^3$ and $A^4$ can be hydrogen, methyl, or ethyl, or $A^4$ can be benzyl. Preferred amine salts are formed with $N(A^1)(A^2)(A^3)$ wherein each of $A^1$, $A^2$ and $A^3$ can be as defined above, or one, two or all three can be 2-hydroxyethyl (e.g. triethanolamine) or $A^3$ can be n-propyl, isopropyl, or cyclohexyl.

Useful anionic surfactants include alkyl benzene sulfonates, such as $C_8$–$C_{20}$-alkyl benzene sulfonates, a preferred example of which is sodium dodecyl benzene sulfonate (sold by Witco Corp. as "Witconate 90 Flake"). Other useful anionic surfactants include alkyl sulfates, such as $C_8$–$C_{20}$ alkyl sulfates, a preferred example of which is sodium lauryl sulfate (sold by Witco Corp. as "Witconate A Powder"). Additional useful anionic surfactants include alcohol ether sulfates, which can be described by the general formula ( $C_8$–$C_{20}$ alkyl or alkenyl)—$(OCH_2CH_2)_n$—$OSO_3X$ in which n is 1–12 and preferably 1–4, the alkenyl chain contains 1–3 carbon-carbon double bonds, and X is a monovalent cation which is preferably an alkali metal or amine, and more preferably sodium or ammonia. Preferred examples of alcohol ether sulfates include sodium deceth sulfate, alcohol ether amine sulfate, and sodium laureth sulfate (sold by Witco Corp. as "Witcolate 7093", "Witcolate AE3" and "Witcolate LES", respectively).

Other useful anionic surfactants are sodium oleyl ether (1.5 EO) sulfate, sodium lauryl/oleyl sulfate, diethyl cyclohexyl amine lauryl sulfate, triethanolamine alcohol sulfate, isopropylamine alkyl benzene sulfonate, and triethanolamine alkyl sulfonate (available commercially from Witco Corp. as "Supralate RA", "Supralate D", "Supralate G", "Witcolate TLS 500", "Witcolate 93S", and "Witcolate 60T", respectively).

Additional useful anionic surfactants are known as olefin sulfonates, which are long chain sulfonate salts prepared by sulfonation of alpha olefins, generally as one or more alpha olefins containing 6 to 20 carbon atoms. The resulting sulfonate salts include compounds exhibiting one, and more commonly both, of the following structural formulas:

$$CH_3(CH_2)_{2\text{-}16}CH{=}CHSO_3Na$$

$$CH_3(CH_2)_{2\text{-}16}CHOH{=}CH_2SO_3Na$$

Sodium $C_{14\text{-}16}$ olefin sulfonates, which are preferred, are commercially available, for instance from Witco Corporation as a product sold under the name "Witconate AOK".

Additional useful anionic surfactants include phosphate ester surfactants, which are generally alkyl or aryl-alkyl phosphates. Preferred examples include the phosphate ester surfactants sold under the name "DeSophos" by Witco Corp. Other useful anionic surfactants include fatty acid soaps especially wherein the acyl moiety contains 6 to 26 carbon atoms.

Useful anionic surfactants also include carboxylated alcohol ethoxylates and carboxylated alkylphenol ethoxylates, such as those sold under the name "Emcol" by Witco Corp. Additional useful anionic surfactants include sarcosinates, which are typically mixtures of anionic compounds corresponding to the formula (FR)—C(O)—$N(CH_3)$—$CH_2COO$—$X^R$ wherein FR is an alkyl radical of 6 to 25 carbon atoms and $X^R$ is a cation, preferably sodium or triethanolamine.

Also useful are disulfonates, especially $C_6$–$C_{26}$ alkyl diphenyloxide disulfonates such as sodium dodecyl diphenyloxide disulfonate ("Dowfax 3B2", Dow).

Additional useful anionic surfactants include carboxylates such as salts of saturated and unsaturated fatty acids containing 8 to 20 carbon atoms. Other useful anionic surfactants are sulfosuccinates, which generally correspond to the formula $$R^1{-}O{-}C(O){-}CH_2CH(SO_3X^1){-}C(O){-}O{-}R^2$$

wherein $X^1$ is a monovalent cation, preferably ammonium or an alkali metal and more preferably sodium; and each of $R^1$ and $R^2$ is straight or branched alkyl, cycloalkyl, or cycloalkyl-alkyl, containing 6 to 18 carbon atoms, such as cyclohexyl, heptyl, hexyl, or 1-methylpentyl; or $R^1$ is $X^1$ as defined above, and $R^2$ has the formula $R^3$—$(OCH_2CH_2)_{0\text{-}12}$, $R^3$—C(O)NH—$CH_2CH_2$—$(OCH_2CH_2)_{0\text{-}6}$, or $R^3$—C(O)NH— (iso-$C_3H_6$)—$(OCH_2CH_2)_{0\text{-}6}$, wherein $R^3$ is straight or branched alkyl or alkenyl containing 8 to 20 carbon atoms and 0 to 3 carbon-carbon double bonds and is optionally substituted with hydroxyl.

Examples of useful, commercially available sulfosuccinates abound and are well known, such as dicyclohexyl sodium sulfosuccinate, disodium cocamido MEA-sulfosuccinate ("REWOPOL 1026", Witco Corp.), disodium laureth sulfosuccinate (REWOPOL SBFA 1, 3 or 30, Witco Corp.), and disodium myristamido MEA-sulfosuccinate (EMCOL 4100M, Witco Corp.).

Suitable nonionic surfactants which may be present in the compositions of the present invention include ethylene oxide adducts of primary and secondary, branched or straight-chain, alkanols and alkenols containing 8 to 20 carbon atoms in the alcohol chain and an average of 1 to 30 moles of ethylene oxide. Other suitable nonionic surfactants include ethylene oxide adducts of branched and straight-chained, alkyl phenols and alkenyl phenols containing 6 to 28 carbon atoms in the alkyl or alkenyl chain and 1 to 10 moles of ethylene oxide. Additional suitable nonionic surfactants include analogs of the foregoing ethylene oxide adducts wherein all or a portion of the ethylene oxide is replaced with propylene oxide.

Other nonionic surfactants useful herein include lower alkyl $C_1$–$C_4$ esters of long chain fatty acids containing 8 to 24 carbon atoms, as well as esters of fatty alcohols containing 8 to 24 carbon atoms acylated with lower $C_1$–$C_4$ alkanoic acids. Also useful are ethoxylates of $C_8$–$C_{26}$ fatty acids with generally up to 40 ethoxy units, as well as ethoxylated glyceryl esters of $C_8$–$C_{26}$ fatty acids. Examples of the latter include PEG-30 glycerol cocoate and PEG-20 glyceryl tallowate ("Varonic LI-63" and "Varonic LI-42", respectively (Witco Corp.).

Additional useful nonionic surfactants include monoethanolamides and/or diethanolamides of fatty acids containing 8 to 18 carbon atoms and 0 to 3 carbon-carbon double bonds. Monoethanolamides and diethanolamides generally exhibit the formula $R^4C(O)$—$NHCH_2CH_2OH$ and $R^4C(O)$—$N(CH_2CH_2OH)_2$, respectively, wherein $R^4$ is alkyl or alkenyl containing 7 to 17 carbon atoms and 0, 1, 2 or 3 carbon-carbon double bonds.

A preferred component is known as cocamide MEA, which is a mixture of ethanolamides of the mixture of fatty acids derived from coconut acid. Cocamide MEA is commercially available, such as from Witco Corporation as a product sold under the trade name "Witcamide CMEA" or "Witcamide MEAC".

Other compounds that are useful as this component include lauric diethanolamide and oleic diethanolamide (sold by Witco Corp. as "Witcamide 6511", "Witcamide 6310" and "Witcamide 6546").

Other useful nonionic surfactants are amine oxides, typically of the formula $(R^W)(R^X)(R^Y)N\rightarrow O$ wherein $R^X$ and $R^Y$ are independently methyl, ethyl or hydroxyethyl, and $R^W$ is $C_8$–$C_{26}$ alkyl or alkenyl, $C_8$–$C_{26}$ acylamidopropyl, $C_8$–$C_{26}$ acylamidoethyl, $C_8$–$C_{26}$ alkoxypropyl, or $C_8$–$C_{26}$ alkoxyethyl.

Amphoteric surfactants that may be present preferably are any which conform to the formula $$(R^M)\text{—}C(O)NH(CH_2)_{2\text{-}3}N(X)(Y)CH_2COO\text{—}$$

wherein $R^M$ is alkyl or alkenyl containing 6 to 25 carbon atoms and 0–3 carbon-carbon double bonds, X is $CH_3$, —$C_2H_5$ or —$CH_2CH_2OH$, and Y is —$CH_3$, —$C_2H_5$ or —$CH_2CO(O)O$—Na. Examples include betaines such as cocoamidopropyl betaine (e.g. "Varion CADG-W", Witco) and N-cocoamidoethyl-N-2-hydroxyethyl-N-carboethoxy glycine, sodium salt ("Varion 2C", Witco).

In general, when one or more additional surfactants are present with the polyamine alkoxylate component described herein, the weight ratio of the polyamine alkoxylate component to the total of other surfactants present which do not conform to formula (A) and formula (B) should be in the range of 1:99 to 99:1. It is preferred that the amine alkoxylate component constitutes at least 50 wt. % and preferably at least 75 wt. %, of the total surfactant content of the composition.

In addition, the weight ratio of all surfactants of formula (A) and formula (B) present to all other surfactant present should be in the range of 1:10 to 10:1 and is more preferably about 1:1 to 5:1, and more preferably about 3:1 to 1:3.

In another useful aspect of the present invention, the compositions can also contain an effective amount of an enzyme component which comprises one or more enzymes capable of assisting the removal of stain or soil from a surface.

The enzyme component includes any enzyme which assists in the removal of soil or stain from a substrate (including particularly fabric and hard surfaces). Particularly useful enzymes include carbohydrases, especially amylases α-amylases and β-amylases, and cellulases; lipases; and proteases.

Amylases and cellulases are particularly useful against carbohydrates e.g. starches and other polysaccharides. Thus they provide cleaning activity against plant-derived soil and stains, such as grass stains, coffee, tea, grape juice, ketchup, and the like. Lipases are esterases which hydrolyze esters of glycerol and fatty acids. Thus, lipases are particularly useful in providing cleaning activity against soil and stains which contain an ester linkage, such as oils, fats, and greases. Proteases hydrolyze peptides and proteins, and thus are particularly useful in providing cleaning activity against proteinaceous soil and stains such as blood as well as other foreign materials containing an amide bond.

A preferred α-amylase is Termamyl, which is derived from *B. licheniformis*. Other useful α-amylases include Alphamyl, Asperzyme, Clarase, Mycolase, Mycozyme, Rapidase, Rhozyme, and Tenase. A preferred cellulase is Celluzyme. A preferred lipase is Lipolase. Other useful lipases include pancreatin. A preferred protease is Alcalase. Other preferred proteases include Esperase.

The enzyme component generally comprises 0.1 wt. % up to about 5 wt. % and preferably 0.5 wt. % to 2 wt. %, by weight of the amount of the composition.

This aspect of the present invention is particularly significant and unexpected because such enzyme cleaning agents are known to be susceptible to loss of activity when they come into contact with surfactants. It has now been found, however, that compositions containing an amine alkoxylate component as defined herein, and an enzyme component, provide very satisfactory cleaning without loss of enzyme activity. Indeed, the enzyme cleaning activity is often increased, which is the opposite of what would be expected.

This retention and increase of enzyme cleaning activity are also observed in compositions that contain the polyamine alkoxylate component of formula (A) and/or formula (B) and also contain an anionic surfactant. This observation is quite unexpected, in view of the expectation in this field that an anionic surfactant would be especially harmful to the cleaning activity of the enzyme.

In those preferred aspects of the present invention wherein the polyamine alkoxylate component is part of a completed detergent formulation, it is optional but preferred to include on the order of 25 to 99 wt. % of additional detergent components conventional in this field, such as detergency builder salts, fillers, bleaching agents, stabilizers, and/or brighteners, as well as what may be termed aesthetic additives present in minor amounts sufficient to impart desired color, fragrance, as well as antioxidants and/or preservatives, and including viscosity control agents and thickeners.

For example, typically detergent formulations can include the following:

| Components | Phosphate | Non-phosphate |
|---|---|---|
| Surfactants - amine alkoxylate (s) plus anionics and/or nonionics | 9–20% | 9–23% |
| Builders | | |
| Phosphate | 28–42% | — |
| Carbonate | 6% | 23% |
| Zeolite | — | 25% |
| Polyacrylates | 0.4% | 0.8% |
| Sodium silicate | 5–15% | 5–15% |
| Fluorescent whitening agent | 0.05–0.25% | 0.05–0.25% |
| Perfume, Dye, CMC | q.s. | q.s. |
| Water | 12–14% | 3–5% |
| Sodium sulfate | to 100% | to 100% |

The preferred phosphates include sodium tripolyphosphate and tetrasodium pyrophosphate. Optionally, up to about 6 wt. % sodium carbonate can also be present. The polyacrylate polymers enhance builder performance. Sodium carboxymethyl cellulose helps to inhibit redeposition of soil onto the fabric. The sodium silicate helps to inhibit corrosion of washing machine surfaces, and helps act as a builder.

Properties and Uses

The compositions described herein containing a polyamine alkoxylate component of formula (A), formula (B), or both, exhibit many properties that render the compositions very useful in many applications, including but not limited to application as a detergent or cleaner. In many instances, these properties exceed the performance of other compositions that lack an amine alkoxylate component. Among the properties that render these compositions useful in many areas are:

The compositions of the present invention are free flowing liquids, even at very high surfactant concentrations, and even at room temperature or cooler. They are 100% actives liquids, and clear, even at room temperature. By comparison, alcohol ethoxylates like "Neodol 25-7" are hazy at room temperature. Thus, one need not heat the composition to increase its fluidity, as is often needed with compositions of other materials when the compositions have been kept in a cool basement or warehouse.

The compositions of the present invention do not exhibit a tendency to form gels in water, even at high concentrations. Indeed, the polyamine alkoxylate has the property that its presence breaks gels formed by nonyl phenol ethoxylate or alcohol ethoxylate, in water. Both of these types of compounds have a strong tendency to form gels in water, e.g. at 40 wt. % in water. Adding even up to 20 wt. % of polyamine alkoxylate breaks the gel and restores a fluid liquid.

If however one desires to prepare a solid (e.g. particulate) product embodying the present invention, and other components used in solid products, the components can readily be converted to a free flowing solid by means of conventional equipment and processing technology.

The presence of the polyamine alkoxylate component reduces the need to add other basic compounds such as amines and alkalis to compositions when it is desired to achieve a basic pH. Thus, the polyamine alkoxylate component provides alkalinity along with the other useful properties described herein.

The polyamine alkoxylate component has also been shown to be biodegradable. It is also compatible with cationic components that may be present, such as cationic fabric softeners including quaternary ammonium fabric softeners. The polyamine alkoxylate component also protects against corrosion of equipment surfaces with which it comes into contact.

The polyamine alkoxylate compositions of the present invention also exhibit many desirable properties that are particularly relevant to their use in cleaning, particularly in cleaning fabrics.

Exceptional stain removal is provided by compositions wherein polyamine alkoxylate of formulas (A) and (B) as defined herein is the sole surfactant component, and by compositions containing a polyamine alkoxylate component as defined herein and another surfactant such as anionic and/or second nonionic and/or amphoteric surfactant. Stain removal is provided as to proteinaceous stains such as blood; hydrocarbons such as oils, fats, grease, and wax, such as lipstick; vegetable material such as grass stains, ketchup, wine, fruit juice, grape juice, tea, chocolate, coffee, and the like; and organic and inorganic material such as ink, makeup, paint and so forth.

In practice, one applies to the stain a quantity of a composition which contains a polyamine alkoxylate component of formula (A) and/or (B) as defined herein. A concentrated composition can be used, for instance by pouring a small amount onto the stain to wet its surface completely. Alternatively, one can use a more dilute composition, again by pouring a quantity directly onto the stain or immersing the stained material (e.g. fabric) into an aqueous washing medium such as in a washbowl or in the tub of an automatic clothes washing machine. The composition is allowed to remain in contact with the stain for an effective time of a few seconds to an hour, or longer, whereupon the article can be rinsed and dried. If desired, the article can then be washed through the regular cycle of an automatic clothes washing machine.

The compositions for stain removal can be formulated into any desired form for application, such as a pourable or sprayable liquid, a gel, or a solid stick-type product; each in a manner conventional in this field.

The compositions of the present invention are thus particularly useful for "prewashing" or "prespotting", wherein the composition is applied to all or part of an article, such as a stained portion, optionally left alone for up to about 5 minutes, and then washed in an aqueous washing medium with a detergent.

The compositions of the present invention are also highly effective in removing soil from fabric. This performance has been observed with various types of soil including dust-sebum; hydrophobic material such as oily particulate material; and silicaceous dirt, clay and dust, such as ground-in clay.

Highly effective performance has been observed on a variety of fabrics including cotton, cotton-polyester blends, polyester, nylon, wool, silk, and rayon, as to stain removal and "prewashing", and as to soil removal, in use as a fully built-up detergent or as an aqueous formulation containing only the polyamine alkoxylate component; or containing only the polyamine alkoxylate, and anionic surfactant and/or second nonionic surfactant.

This performance has also been found to be available when the composition is used at conventional washing temperatures, that is, generally about 80° F. to about 110° F. Notably, effective performance has also been observed at lower washing temperatures of, generally, about 40° F. to about 75° F., such as about 50° F. The compositions of the present invention also exhibit highly effective performance over a wide range of water hardness levels, at 100 ppm to 300 ppm of hardness and even up to 500 ppm.

Another very useful property of the compositions of the present invention is that dyed fabric which is contacted with such compositions, directly or in an aqueous washing machine, is made cleaner while exhibiting reduced dye loss and dye transfer from the dyed fabric. This property is evident with any of the various kinds of dyes used on fabrics, including those known as acid dyes, basic dyes, direct dyes, disperse dyes, reactive dyes, sulfur dyes, and vat dyes. Examples are many and well known, including but not limited to those disclosed in Kirk-Othmer, *Encyclopedia of Chemical Technology,* Vol. 8, pp. 159–392.

This dye loss inhibition is also evident when the polyamine alkoxylate of formula (A) and/or (B) is used with an anionic surfactant, since anionic surfactants are generally associated with an increased tendency to promote dye loss and dye transfer from fabric washed in anionic surfactant. Thus, these compositions—including compositions wherein the polyamine alkoxylate component of formula (A) and/or (B) is the only surfactant component present, as well as compositions wherein such a polyamine alkoxylate component is present with an anionic surfactant and/or second nonionic surfactant—form useful "colorfast" laundry product.

To state a general manner of using these compositions to clean, one generally employs at least about 20 g to about 120 g solids content of surfactant with a 3 to 8-pound load of clothing to be washed. The particular amount of surfactant is not critical, as in general more surfactant correlates with better and/or faster cleaning.

For stain removal, the stain removal composition is preferably left on the stain for 10 seconds to 10 minutes, whereupon the substrate article can be rinsed and dried, or laundered and then rinsed and dried. The product applied to the stain should comprise at least 0.1 wt. % of an amine alkoxylate component.

EXAMPLE

This Example demonstrates the superior performance of polyamine alkoxylate, compared to other nonionic surfactants, in inhibiting dye loss and dye transfer upon washing dyed fabric.

Inhibition of dye loss and dye transfer were tested by ASTM Test No. D-5548-94, "Evaluating Color Transfer or Color Loss of Dyed Fabric in Home Laundry", the content of which is hereby incorporated herein by reference. Swatches of nylon fabric dyed with Acid Red 151, and cotton fabric dyed with either Direct Blue 90 or Direct Blue 1, were each washed in surfactant under standardized, identical conditions (90 RPM, 40 minutes, about 120° F., water hardness about 110 ppm) together with a swatch of undyed (white) cotton fabric (swatches dyed with different dyes were not washed together). The washed, dyed and undyed, swatches were recovered, rinsed in 70° F. rinse water and air dried.

The surface reflectance, the redness/greenness, and the yellowness/blueness, of each fabric was measured with a photoelectric calorimeter both before and after washing, under conditions identical for each swatch. The total color difference ("ΔE") for each surfactant was calculated from the following equation:

$$\Delta E=(L_w-L_o)^2+(a_w-a_o)^2+(b_w-b_o)^2$$

wherein

L=reflectance a=redness/blueness b=yellowness/blueness w=fabric before washing

O=fabric after washing

A lower ΔE value represents less dye transfer and thus a better performing product. The results are set forth in the following Table:

The following dye transfer inhibition tests were run to evaluate the dye transfer inhibition properties of di and tri amine ethoxylates. All tests were run according to ASTM test method D = 5548.

| | |
|---|---|
| Wash Water temp. | 120 F. |
| Water hardness | 110 ppm |
| Wash duration | 40 min |
| Rinse water temp. | 70 F. |
| Rinse water hardness | 110 ppm |
| Agitation | 90 RPM |
| Drying | Air dry |

| Surfactant | Dosage | Dyed Cloth | Swatch # | Delta E | Avg. Delta E |
|---|---|---|---|---|---|
| Adogen 560 + 3 EO | 0.1 g/L | Red 151 | 1 | 48.38 | |
| | | Blue 90 | 2 | 23.67 | |
| | | Blue 1 | 3 | 5.98 | 26.0 |
| Adogen 560 + 5 EO | | Red 151 | 4 | 32.75 | |
| | | Blue 90 | 5 | 21.88 | |
| | | Blue 1 | 6 | 10.71 | 21.8 |
| Adogen 560 + 10 EO | | Red 151 | 7 | 29.1 | |
| | | Blue 90 | 8 | 23.59 | |
| | | Blue 1 | 9 | 10.57 | 21.1 |
| Adogen 560 + 15 EO: | | Red 151 | 10 | 30.4 | |
| | | Blue 90 | 11 | 24.31 | |
| | | Blue 1 | 12 | 11.17 | 22.0 |
| Adogen 670 + 4 EO | | Red 151 | 13 | 20.5 | |
| | | Blue 90 | 14 | 27.46 | |
| | | Blue 1 | 15 | 5.63 | 17.9 |
| Adogen 670 + 10 EO | | Red 151 | 16 | 14.41 | |
| | | Blue 90 | 17 | 14.14 | |
| | | Blue 1 | 18 | 5.2 | 11.3 |
| Adogen 670 + 15 EO | | Red 151 | 19 | 22.93 | |
| | | Blue 90 | 20 | 11.94 | |
| | | Blue 1 | 21 | 4.71 | 13.2 |
| Adogen 670 + 20 EO | | Red 151 | 22 | 24.34 | |
| | | Blue 90 | 23 | 11.53 | |
| | | Blue 1 | 24 | 4.34 | 13.4 |
| Adogen 670 + 10EO 0.3 gm. | | Red 151 | 25 | 25.21 | |
| Plus 93S 0.3 gm. | | Blue 90 | 26 | 39.89 | |
| | | Blue 1 | 27 | 15.5 | 26.9 |
| Adogen 670 + 10EO 0.48 gm. | | Red 151 | 28 | 8.71 | |
| Plus 93S 0.12 gm. | | Blue 90 | 29 | 17.88 | |
| | | Blue 1 | 30 | 7.47 | 11.4 |

| Surfactant | Dosage | Avg. Delta E |
|---|---|---|
| Adogen 670 + 10 EO | 0.025 g/L | 15.1 |
| Adogen 670 + 10 EO | .05 g/L | 10.0 |
| Adogen 670 + 10 EO | .075 g/L | 11.4 |
| Adogen 670 + 10EO + H2SO4 to pH3@0.3 g + 93S@0.3 g | | 10.1 |
| Adogen 670 + 10EO + H2SO4 to pH3@0.1 g + 93S@0.5 g | | 29.9 |
| Adogen 670 + 10EO + H2SO4 to pH3@0.2 g + 93S@0.4 g | | 28.0 |
| Adogen 670 + 10EO + H2SO4 to pH6.3@+0.3 g + 935@0.3 g | | 20.4 |
| Adogen 670 + 10EO 0.3 gm. Plus LES60-C 0.5 gm. | | 19.3 |
| Adogen 670 + 10EO + H2SO4 to pH6.3@0.3 g + LES60-C@0.5 g | | 12.8 |
| Adogen 670 + 10EO + H2SO4 to pH3.0@0.3 g + LES60-C@0.5 g | | 8.3 |
| Adogen 670 + 10EO 0.3 gm. Plus 25-7-C 0.3 gm. | | 5.2 |
| Adogen 670 + 10EO 0.12 gm. Plus 25-7-C 0.48 gm. | | 6.5 |
| Adogen 670, 10EO 0.12 g + LES60C 0.2 g + Neodol 25-7 0.36 | | 19.5 |
| Adogen 670, 10EO 0.12 g + LES60C 0.2 g + 25-7 0.24 + V-365 0.4 g | | 16.9 |
| Adogen 670, 10EO 0.12 g + LES60C 0.2 g + 25-7 0.24 + AMB-14 0.36 g | | 13.7 |
| Adogen 670 + 10EO + H2SO4 to pH6.3@0.12 g + LES60-C 0.2 g +25-7 0.24 g + AMB-14 0.36 g | | 8.7 |

What is claimed is:

1. A method of cleaning dyed fabric while inhibiting loss of dye from the fabric, comprising washing the dyed fabric with an aqueous cleaning composition comprising a polyamine alkoxylate component selected from the group consisting of:

(a) compounds of formula (A):

(A)

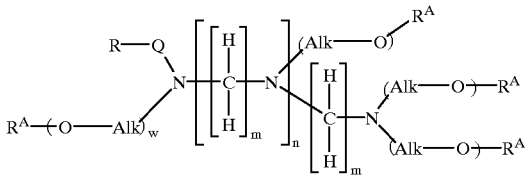

and mixtures thereof, wherein R is an alkyl or alkenyl radical containing 6 to 25 carbon atoms and 0 to 3 carbon-carbon double bonds, Q is —$OCH_2CH_2CH_2$—, —C(=O)$OCH_2CH_2$—, —C(=O)$NHCH_2CH_2CH_2$—, or —$CH_2$—;

each occurrence of $R^A$ is independently H, —OC(=O)R, —$SO_3$—$A^+$, or —$CH_2$C(=O)O—$A^+$ wherein $A^+$ is an alkali metal cation, ammonium, or $H^+$;

each occurrence of m is 3 to 8;

each Alk is independently ethyl, isopropyl or n-propyl, v, w, x and y are each independently 1 to 20, n is 1 to 10; and the sum of (v+w+x+y) is (3+n) to 20;

(b) compounds of formula (B) composed of (i) a cation wherein one or more nitrogen atoms of a compound of formula (A) is additionally substituted with hydrogen, methyl, ethyl, hydroxyethyl or benzyl, and (ii) one or more anions, equal in number to the number of the additionally substituted nitrogen atoms, being selected from the group consisting of chloride, methylsulfate, and ethylsulfate; and (c) compounds corresponding to amine oxides of compounds of formula (A).

2. The method according to claim 1, wherein the total amount of compounds of formula (A) and formula (B) in the composition is at least 80 wt. %.

3. The method according to claim 1, wherein the total amount of compounds of formula (A) and formula (B) in the composition is 0.1 wt. % to 20 wt. %.

4. The method according to claim 1, wherein the total amount of compounds of formula (A) and formula (B) in the composition is 20 wt. % to 80 wt. %.

5. The method according to claim 1, wherein in formula (A) each Alk group is ethyl.

6. The method according to claim 5, wherein the total amount of compounds of formula (A) and formula (B) in the composition is at least 80 wt. %.

7. The method according to claim 5, wherein the total amount of compounds of formula (A) and formula (B) in the composition is 0.1 wt. % to 20 wt. %.

8. The method according to claim 5, wherein the total amount of compounds of formula (A) and formula (B) in the composition is 20 wt. % to 80 wt. %.

9. The method according to claim 1 of washing a dyed fabric with an anionic surfactant having a tendency to remove dye from the fabric, comprising washing the dyed fabric with an aqueous cleaning composition comprising a polyamine alkoxylate component consisting of compounds of formula (A) and further comprising an anionic surfactant.

10. The method according to claim 9, wherein the ratio by weight of the amount of polyamine alkoxylate present to the amount of anionic surfactant present is 1:10 to 10:1.

11. The method according to claim 9, wherein the total amount of compounds of formula (A) in the composition is at least 80 wt. %.

12. The method according to claim 9, wherein the total amount of compounds of formula (A) in the composition is 0.1 wt. % to 20 wt. %.

13. The method according to claim 9, wherein the total amount of compounds of formula (A) in the composition is 20 wt. % to 80wt. %.

14. The method according to claim 9, wherein in formula (A) each Alk group is ethyl.

15. The method according to claim 14, wherein the ratio by weight of the amount of polyamine alkoxylate present to the amount of anionic surfactant present is 1:10 to 10:1.

16. The method according to claim 14, wherein the total amount of compounds of formula (A) in the composition is at least 80 wt. %.

17. The method according to claim 14, wherein the total amount of compounds of formula (A) in the composition is 0.1 wt. % to 20 wt. %.

18. The method according to claim 14, wherein the total amount of compounds of formula (A) in the composition is 20 wt. % to 80 wt. %.

19. A compound selected from the group consisting of:

(a) an ionic polyamine alkoxylate compound comprising: (i) a cation of formula (A)

(A)

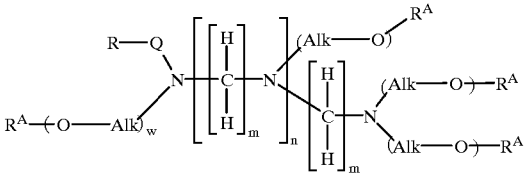

wherein R is an alkyl or alkenyl radical containing 6 to 25 carbon atoms and 0 to 3 carbon-carbon double bonds, Q is —$OCH_2CH_2CH_2$—, —C(=O)$OCH_2CH_2$—, —C(=O)$NHCH_2CH_2CH_2$—, or —$CH_2$—;

each occurrence of $R^A$ is independently H, —OC(=O)R, —$SO_3$—$A^+$, or —$CH_2$C(=O)O—$A^+$ wherein $A^+$ is an alkali metal cation, ammonium, or $H^+$;

each occurrence of m is 3 to 8;

each Alk is independently ethyl, isopropyl or n-propyl, v, w, x and y are each independently 1 to 20, n is 1 to 10; and the sum of (v+w+x+y) is (3+n) to 20 wherein one or more nitrogen atoms of the compound of formula (A) is additionally substituted with hydrogen, methyl, ethyl, hydroxyethyl or benzyl, and (ii) one or more anions, equal in number to the number of the additionally substituted nitrogen atoms, being selected from the group consisting of chloride, methylsulfate, and ethylsulfate, and mixtures thereof; and (b) compounds corresponding to amine oxides of compounds of formula (A).

20. A cleaning composition for fabric comprising one or more compounds according to claim 19.

* * * * *